US009309791B2

(12) United States Patent
Trzmiel

(10) Patent No.: US 9,309,791 B2
(45) Date of Patent: Apr. 12, 2016

(54) VALVE CONTROL FOR A GAS EXCHANGE VALVE OF AN INTERNAL COMBUSTION ENGINE

(71) Applicant: Alfred Trzmiel, Nürtingen (DE)

(72) Inventor: Alfred Trzmiel, Nürtingen (DE)

( * ) Notice: Subject to any disclaimer, the term of this patent is extended or adjusted under 35 U.S.C. 154(b) by 69 days.

(21) Appl. No.: 14/460,371

(22) Filed: Aug. 15, 2014

(65) Prior Publication Data

US 2015/0075466 A1 Mar. 19, 2015

(30) Foreign Application Priority Data

Aug. 16, 2013 (DE) ..... 10 2013 013 913

(51) Int. Cl.
*F01L 13/00* (2006.01)
*F01L 1/18* (2006.01)

(52) U.S. Cl.
CPC ..... *F01L 13/0026* (2013.01); *F01L 1/185* (2013.01); *F01L 13/0063* (2013.01); *F01L 2013/0068* (2013.01)

(58) Field of Classification Search
CPC ... F01L 13/0026; F01L 1/185; F01L 13/0063; F01L 2013/0068
USPC ..... 123/90.16
See application file for complete search history.

(56) References Cited

U.S. PATENT DOCUMENTS

| | | | | |
|---|---|---|---|---|
| 2005/0028766 | A1 | 2/2005 | Schon et al. | |
| 2006/0021590 | A1 | 2/2006 | Bosl-Flierl et al. | |
| 2007/0022990 | A1 | 2/2007 | Werler et al. | |
| 2007/0119401 | A1 * | 5/2007 | Hiraiwa | 123/90.16 |

FOREIGN PATENT DOCUMENTS

| | | | |
|---|---|---|---|
| DE | 29 51 361 | A1 | 7/1981 |
| DE | 4112833 | A1 | 6/1992 |
| DE | 10140635 | A1 | 4/2003 |
| EP | 1 619 361 | A1 | 1/2006 |
| EP | 1 754 865 | A2 | 2/2007 |

* cited by examiner

*Primary Examiner* — Zelalem Eshete
(74) *Attorney, Agent, or Firm* — Gudrun E. Huckett

(57) ABSTRACT

A valve control device for a gas exchange valve of an internal combustion engine has a cam follower lever interacting with the camshaft. A rocker arm rests on the cam follower lever and actuates the valve. An adjusting device acts on the rocker arm to adjust a valve lift. The rocker arm has first and second control surfaces with first and second radii of curvature, respectively, The cam follower lever has a third control surface with third radius of curvature. The first control surface contacts a fourth control surface of a guide element of the engine with fourth radius of curvature. The second control surface of the rocker arm contacts a valve element. The first to fourth radii of curvature are adjusted such that, when adjusting the valve lift, the valve does not open when the cam follower lever rests on a cam base circle section of the camshaft.

18 Claims, 2 Drawing Sheets

VALVE CONTROL FOR A GAS EXCHANGE VALVE OF AN INTERNAL COMBUSTION ENGINE

BACKGROUND OF THE INVENTION

The invention relates to a valve control device for a gas exchange valve of an internal combustion engine, comprising a cam follower lever interacting with a camshaft and a rocker arm that is contacting the cam follower lever and that actuates the valve. The rocker arm is adjustable for valve lift adjustment by means of an adjusting device.

Mechanically fully variable valve control devices are known and are employed for reducing fuel consumption in internal combustion engines of passenger cars (DE 101 40 635 A1). The cam follower lever is pivotable about an axis and is positioned with a first roller on a guide and with a second roller on an adjusting device that is in the form of a slidable adjusting bar. For changing the valve lift, the adjusting bar is displaced and the cam follower lever adjusted thereby. The rocker arm is resting on the cam follower lever. The rocker arm is supported with a first lever end on the cylinder head of the internal combustion and actuates with a second lever end the gas exchange valve. As the camshaft rotates, the cam follower lever moves by means of a roller along a curved path of a guide provided at the cylinder head. The manufacture and support of the guide are complex. Extremely high engine speeds are not possible because the main mass of the cam follower lever is high. Mounting of the guide in the cylinder head is also very complex.

A further valve control device (DE 41 12 833 A1) is known in which the cam follower lever and the rocker arm are formed by two pivotably supported single-arm levers. The cam follower lever is connected with one end rotatably on an eccentric whose eccentric shaft is eccentrically supported in an actuator that is rotatable about a fixed axis associated with the cylinder head. The cam follower lever is resting on the rocker arm which, in turn, is also pivotably supported about a fixed axis that is associated with the cylinder head. By means of the eccentric, the cam follower lever is linearly displaced and in this way the valve lift is adjusted. The adjusting device with the eccentric and the actuator is very complex and expensive. During adjustment, a significant friction force is produced so that the potential for reducing consumption of the internal combustion engine is limited. The eccentric of the adjusting device enables moreover only a minimal adjusting travel so that the valve control device is not suitable for large valve lift adjustments. A lift adjustment of only approximately 50% of the maximum lift can be achieved.

In another known valve control device (US 2005/0028766 A1), the rocker arm is pivotably supported about an axis. In order to adjust the valve lift, the axis of rotation of the rocker arm or the axis of rotation of the cam follower lever is moved. The movability increases the constructive expenditure of the valve control device. The rocker arm and the cam follower lever are contacting each other with curved control surfaces that are substantially positioned at a slant to the valve axis. This causes significant friction forces when the valve control device is operating. Due to the adjustable elements, the valve control device does not operate at a low noise level.

In a further known valve control device (US 2006/0021590 A1), the rocker arm is pivotably supported in the cylinder head and is resting on the valve to be actuated. The cam follower lever is designed as a rocker lever that is rotatably supported about a central axis. The axis of rotation of the cam follower lever can be moved along a guide that is secured on the cylinder head in order to adjust the valve clearance. The valve control device has therefore a complex and failure-prone configuration.

Also, a valve control device is known (DE 29 51 361 A1) in which the rocker arm is pivotably connected at one end to a slide that is slidable transverse to the axis of the valve for valve lift adjustment. For this purpose, a complex adjusting drive is required.

SUMMARY OF THE INVENTION

It is an object of the present invention to configure a valve control device for a gas exchange valve of the aforementioned kind such that with a constructively simple configuration a reliable valve lift adjustment even at high engine speeds of the internal combustion engine is ensured wherein the energy consumption for maintaining and adjusting the valve lift is minimal.

In accordance with the present invention, this is achieved in accordance with the present invention in that the cam follower lever and the rocker arm have curved control surfaces, in that the rocker arm with a first control surface is resting on a curved control surface of a guide element associated with the engine and with a second control surface is resting on a valve element, and in that the radii of curvature of the control surfaces of the cam follower lever, of the guide element, and of the rocker arm are adjusted relative to each other such that, when the valve lift is adjusted, the valve does not open while the cam follower lever is resting on the base circle section of the cam of the camshaft.

In the valve control device according to the invention, the rocker arm is resting with its curved control surfaces on a guide element associated with the engine and on a valve element. The radii of curvature of the control surfaces of the cam follower lever, of the guide element, and of the rocker arm are adjusted relative to each other such that, when adjusting the magnitude of the valve lift, the valve does not open as long as the cam follower lever is resting on the base circle section of the cam. Due to the radii of curvature that are adjusted relative to each other, it is ensured that, upon adjustment of the valve lift, the gas exchange valve does not open in the compression phase and in the working phase of the internal combustion engine. This adjustment of the valve lift is done when the cam follower lever is resting on the base circle section of the cam of the camshaft. Since the two control surfaces of the rocker arm and the control surface of the guide element are curved, only a very minimal friction occurs upon operation of the valve control device so that the valve lift adjustment can be carried out reliably.

In a preferred embodiment, the control surface of the guide element has a greater radius of curvature than the first control surface of the rocker arm. Accordingly, between the two control surfaces of the guide element and of the rocker arm, only a linear contact is substantially existing, which contributes to a low-friction operation and adjustment of the rocker arm relative to the guide element.

However, it is also possible that both control surfaces of guide element and rocker arm have the same radius of curvature.

The second control surface of the rocker arm, with which it is resting on the guide element, has advantageously a smaller radius of curvature than the first control surface of the rocker arm and/or the control surface of the guide element.

A contribution to a low-friction operation of the valve control device is provided in an advantageous manner when the cam follower lever is resting with a curved control surface on the rocker arm.

Advantageously, the control surface of the cam follower lever has a first control surface section with a section radius of curvature. The cam follower lever is pivoted by the camshaft in a known way back and forth wherein the rocker arm resting on the cam follower lever is moved by the required magnitude in order to open or close the valve.

Advantageously, the first control surface section of the cam follower lever passes, continuously curved, into a second control surface section which is curved opposite to the first control surface section. Due to the differently oriented curvature of the two control surface sections, the rocker arm can be adjusted such that for one revolution of the camshaft the valve will not open depending on whether the contact between the cam follower lever and the rocker arm occurs at the first or the second control surface section. By means of the two control surface sections it is possible to adjust in a continuous way (no steps) the valve lift from 0 to a maximum.

In order to achieve a friction that is as minimal as possible, the rocker arm is advantageously resting with a freely rotating roller on the control surface of the cam follower lever.

In an especially advantageous embodiment, the rocker arm is provided with a through bore through which the adjusting device extends. In this way, there is the possibility to mount the adjusting device while the rocker arm is already installed. On the other hand, in this way there is also the possibility to mount the rocker arm after the adjusting device has already been mounted. In both cases, the rocker arm can be demounted, if needed, without the adjusting device having to be removed also.

A very compact configuration of the valve control device results when the adjusting device has a control shaft which is provided with a control surface on which the rocker arm is resting. The control shaft requires only little space for installation. In particular, the control shaft can be used for several valve control devices provided within the internal combustion engine. The through opening is designed advantageously such that it is open toward the edge of the rocker arm. This facilitates mounting of the control shaft and/or of the rocker arm.

Preferably, the control surface is the circumferential surface of an eccentric member of the control shaft. Since an internal combustion engine has several valve control devices for the gas exchange valves, it is thus possible to provide a common control shaft for all valve control devices. The eccentric member of the control shaft is designed such that it does not project past the circumference of the control shaft. Accordingly, the outer diameter of the control shaft determines the size of the through opening of the rocker arm.

The rocker arm is positioned advantageously with a freely rotating roller on the control surface of the control shaft so that in this contact area only minimal frictional forces occur.

In another embodiment according to the invention, the rocker arm is floatingly supported. No complex rotary support is required so that the constructive configuration of the valve control device and thus of its manufacturing costs are minimal. The rocker arm is secured between the adjusting device and the cam follower lever. When a valve lift adjustment is to be performed, the floatingly supported rocker arm is displaced transversely to the axis of the valve so that the relative position of the cam follower lever and of the rocker arm relative to each other is changed.

The guide element is advantageously adjustable transversely to the axis of the control shaft. In this way, the position of the rocker arm can be adjusted precisely.

The rocker arm is secured in the mounted position in that the control shaft and the cam follower lever are resting on opposite sides of the rocker arm. In combination with the contact of the rocker arm on the guide element and on the valve element, it is thus ensured in a simple way that the rocker arm maintains its respectively adjusted position reliably. In any position of the control shaft and of the cam follower lever, the rocker arm is positioned transverse to the valve axis between these two elements of the valve control device.

In an advantageous embodiment the adjustment of the rocker arm is realized by means of the valve element and/or by means of an eccentrically adjustable bearing axis of a roller of the cam follower lever that is resting on the camshaft and/or by means of an eccentrically adjustable bearing axis of the roller of the rocker arm resting on the camshaft follower lever and/or by means of an eccentrically adjustable bearing axis of the roller of the rocker arm that is resting on the control shaft and/or by means of the adjustable guide element. The described adjusting possibilities can be provided each individually but also in any combination with each other on the valve control device. Depending on the situation of use of the valve control device, there is therefore the possibility to provide the various adjustments such that the valve lift adjustment is possible in an optimal way.

In an advantageous embodiment, a valve control arrangement is provided that comprises two of the valve control devices as described above that have different control surfaces on the cam follower levers and/or different control surfaces on the control shafts. In this way, the valve lifts of the different valve control devices can be designed differently.

The present invention not only results from the individual claims but also from the features and disclosures provided in the drawings and the description. Accordingly, features and disclosures that are not claimed are considered to be important for the invention inasmuch as they are individually or in combination novel relative to the prior art.

DESCRIPTION OF THE PREFERRED EMBODIMENTS

By means of the valve control device, the lift of the gas exchange valves can be adjusted continuously and individually up to the range of very high engine speeds of the internal combustion engine. The energy consumption for maintaining and adjusting the adjustable valve lift is kept minimal. The valve control device is characterized by an inexpensive manufacture and can be mounted easily.

Figure 1:
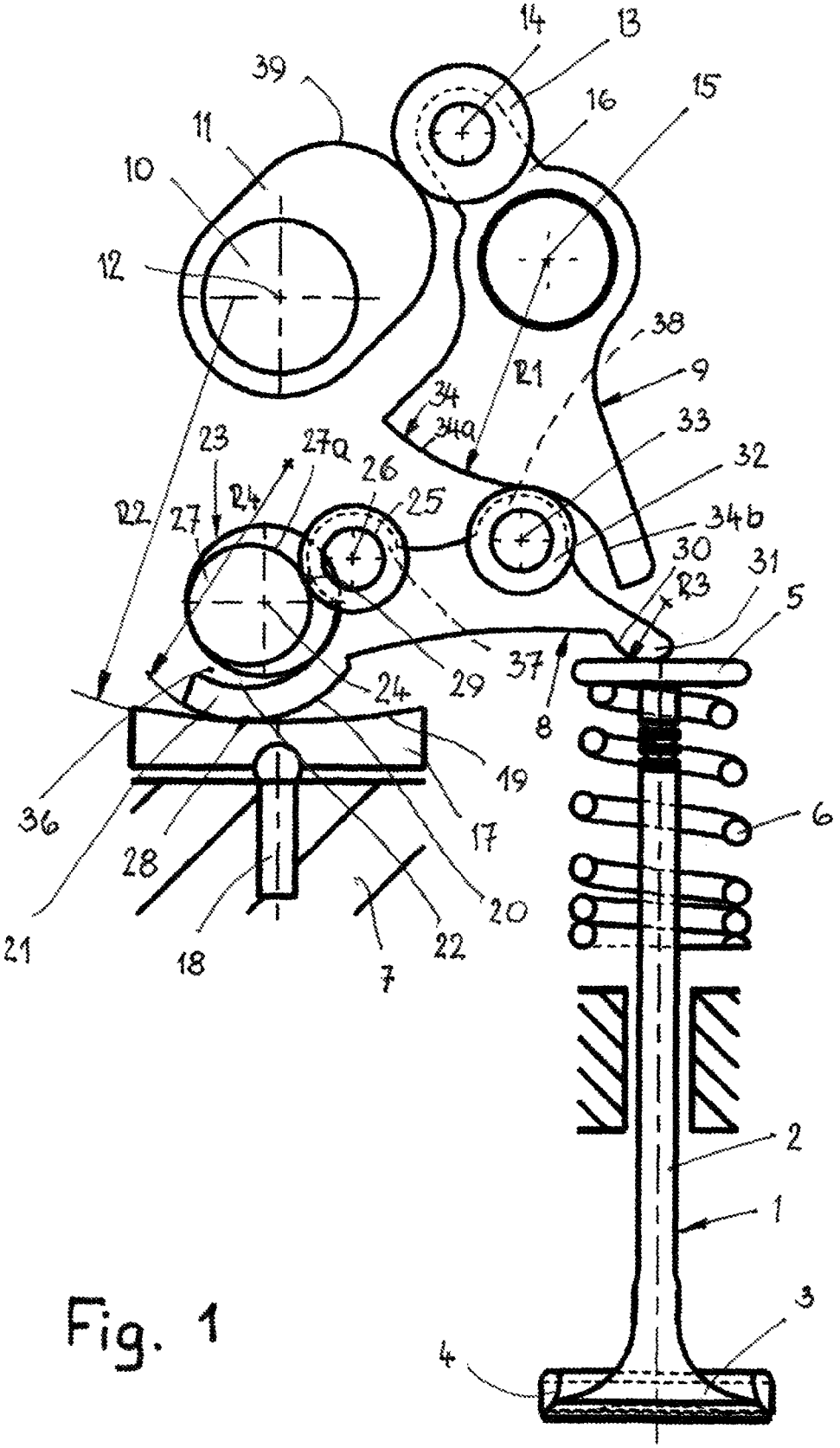
FIG. 1 is a schematic illustration of a valve control device according to the invention with a rocker arm in a first position.

FIG. 1 shows a valve 1 to be controlled that has a valve stem 2 which has at one end a valve plate 3 with which a valve opening 4 can be opened and closed. In the position according to FIG. 1, the valve plate 3 closes the valve opening 4 of the internal combustion engine. At the other end, the valve stem 2 is provided with a valve cap 5. At the cap's underside, a pressure spring 6 is supported which loads the valve stem 2 in the direction of the closed position of the valve plate 3. The pressure spring 6 is supported also on a cylinder head 7 of the internal combustion engine.

At the other side of the valve cap 5, a rocker arm 8 is resting which is interacting with a cam follower lever 9 that is pivoted by a camshaft 10 whose cams 11 each interact with a respective cam follower lever 9.

The camshaft 10 rotates about axis 12. The cam follower lever 9 is resting with a roller 13 on the cam 11; the roller 13 is supported rotatably about axis 14 on the cam follower lever 9. The cam follower lever 9 is supported about stationary axis 15 pivotably on the cylinder head 7.

The cam follower lever 9 has a radial arm 16 projecting radially relative to pivot axis 15; the roller 13 is rotatably supported on the radial arm 16. The width of the radial arm 16 is smaller than the outer diameter of the roller 13 so that the cam follower lever 9 is resting only with the roller 13 on the cam 11.

The rocker arm 8 is supported on a guide element 17 that is seated on support element 18. It is advantageously supported to be adjustable in axial direction on the cylinder head 7. The support element 18 can be designed, for example, like a screw so that a continuous adjustment of the guide element 17 is possible. The support element 18 can also be hydraulically adjustable.

The guide element 17 has on its side that is facing the rocker arm 8 a concave control surface 19 that has a radius of curvature R2. On the curved control surface 19 of the guide element 17 the rocker arm 8 is resting with a control surface 20. Control surface 20 is convexly curved and has a radius of curvature R4 that is smaller than the radius of curvature R2 of the curved control surface 19. The control surface 20 is advantageously provided on a projecting curved arm 21 of the rocker arm 8. The curved arm 21 is provided on its side opposite the control surface 20 with a concavely curved surface 22 that delimits a through opening 36 for a control shaft 23 partially. The control shaft 23 is designed as an eccentric shaft. By rotation of the eccentric shaft 23 about axis 24, the rocker arm 8 is adjusted transversely to axis 24 and to the valve axis. The maximum adjustment travel is determined by the eccentricity of the control shaft 23. By means of the control shaft 23, the magnitude of the valve lift is adjusted.

The contact of the rocker arm 8 on the control shaft 23 is realized by means of roller 25 which is supported on the rocker arm 8 so as to be freely rotatable about axis 26. The roller 25 projects past the surface 22 and is resting on a circumferential surface 27*a* of an eccentric member 27 of the control shaft 23.

The contact area 28 between the two control surfaces 19, 20 and the contact area 29 between the roller 25 and the eccentric member 27 are located on opposite sides of the axis 24 of the control shaft 23 as well as at different levels.

The rocker arm 8 is positioned on the valve cap 5 with a control surface 30 that is convexly curved and has the radius of curvature R3. The radius of curvature R3 is smaller than the radii of curvature R2 and R4. The contact side of the valve cap 5 is planar. As a result of the curved control surface 30 the friction between the rocker arm 8 and the valve cap 5 is minimal. The control surface 30 is advantageously provided on a projecting arm 31 of the rocker arm 8.

The contact of the rocker arm 8 on the cam follower lever 9 is realized by a freely rotating roller 32 that is rotatable about axis 33 and is projecting past the rocker arm 8 in the direction of the cam follower lever 9. The roller 32 is resting on a curved control surface 34 of the cam follower lever 9. The curved control surface 34 has a control surface section 34*a* which extends in a convex shape with a radius of curvature R1 about axis of rotation 15 of the cam follower lever 9. The control surface section 34*a* passes continuously curved into a concave control surface section 34*b*. As a result of this continuous transition, the roller 32 of the rocker arm 8 upon actuation of the valve 1 can pass without problem from one of the control surface sections onto the other one of the control surface sections.

The rocker arm 8 is provided for passage of the control shaft 23 with an opening 36 which is delimited in the direction of the guide element 17 by the curved arm 21. In this way, it is possible to mount the control shaft 23 after the rocker arm 8 has already been mounted. On the other hand, it is possible in this way to mount or demount the rocker arm 8 even though the control shaft 23 is already installed.

The surface 22 forms also the lateral surface of a projecting arm 37 on which the roller 25 is supported. The through opening 36 is open toward the edge of the rocker arm 8 so that mounting of the control shaft 23 and/or of the rocker arm 8 is possible in a simple way.

In the area of the roller 32, the rocker arm 8 has a projecting arm 38; the roller 32 projects past this arm 38 with a portion of its circumference.

The radii of curvature R1 to R4 of the curved control surfaces on the rocker arm 8 and on the cam follower lever 9 are adjusted relative to each other such that, upon adjustment of the valve lift through the control shaft 23, the gas exchange valve 1 is not opened as long as the roller 13 of the camshaft follower lever 9 is in contact with the base circle section 39 of the cam 11. In FIG. 1 the roller 13 is resting on this base circle section 39 of the cam 11. As a result of the adjustment of the radii of curvature R1 to R4, it is ensured that, when adjusting the valve lift, the valve 1 is not opened in the compression phase and in the working phase of the internal combustion. The adjustment of the magnitude of the valve lift is always realized once the roller 13 is resting on the base circle section 39 of the cam 11. When subsequently the camshaft 10 rotates about its axis 12, the cam follower lever 9 is pivoted about its axis 15 so that the rocker arm 8 is pivoted accordingly. As this happens, the roller 32 moves along the control surface 34 of the cam follower lever 9. The valve 1 is opened and closed in accordance with the adjusted lift. The curved control surface 30 of the rocker arm 8 enables a reliable lift of the valve 1.

Figure 2:
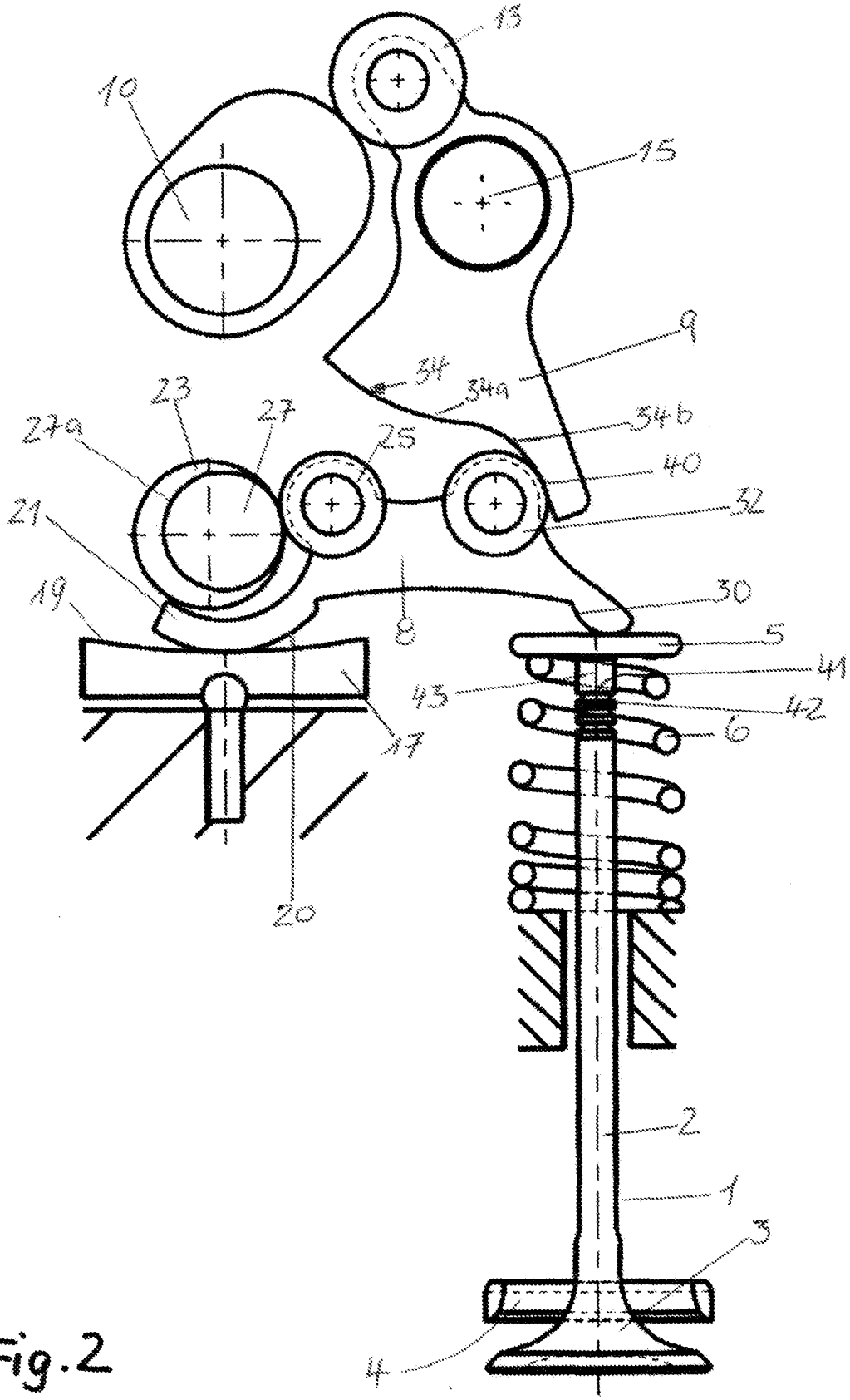
FIG. 2 shows the valve control device according to FIG. 1 with the rocker arm in a second position.

In FIG. 2, the maximum adjustment of the rocker arm 8 by the control shaft 23 is illustrated. In comparison to the position according to FIG. 1, the control shaft 23 is rotated by 180°. Since the rocker arm 8 is resting by means of roller 25 on the eccentric member 27 of the control shaft 23, the rocker arm 8 is moved in FIG. 2 to the right. The arm 21 glides with its control surface 20 on the curved control surface 19 of the guide element 17. At the same time, the rocker arm 8 glides with the control surface 30 on the valve cap 5.

Since the rocker arm 8 is resting with its roller 32 on the control surface 34 of the cam follower lever 9, the movement of the rocker arm 8 by means of the control shaft 23 has also the result that the roller 32 is moved along the control surface 34 of the cam follower lever 9 by an appropriate travel. As a result of the curvature of the control surface 34, the rocker arm 8 is not only moved transverse to the axis of the valve stem 2 but is also minimally pivoted.

Since the rollers 25, 32 of the rocker arm 8 are supported to be freely rotatable, the adjustment of the rocker arm 8 can be carried out reliably with minimal friction. The curved control surfaces 20, 30 assist in the low-friction adjustment of the rocker arm 8.

The floatingly supported rocker arm 8 is reliably secured by the control shaft 23 (i.e., by the contact of the roller 25 on the eccentric member 27), by the roller 32, by the guide element 17, and by the valve cap 5. The cam follower lever 9 which is supported by roller 13 on the camshaft 10 forms the support for the roller 32 of the rocker arm 8. The rocker arm 8 is loaded by means of the cam follower lever 9 toward the control shaft 23 and the valve cap 5. In this way, the rocker arm 8 is securely held in its mounted position. The control shaft 23 and the cam follower lever 9 are resting in any position on opposite sides of the rocker arm 8 so that the rocker arm 8 is positionally secured in its longitudinal direction transverse to the axis of the valve 1.

The rocker arm 8 is a part that can be manufactured in a simple way; on the rocker arm 8, the freely rotatable rollers 25, 32 that have a spacing relative to each other can be mounted in a simple way. The adjustment of the position of the rocker arm 8 is possible in a simple way. For example, the guide element 17 can be fine-adjusted by means of the support element 18 in the axial direction of the support element 18. The adjusting direction is advantageously parallel to the valve axis. A further possibility resides in that the roller 13 of the cam follower lever 9 is designed to be eccentrically adjustable. The adjusting direction is advantageously parallel to the valve axis. A further possibility of positional adjustment resides in that the roller 32 with which the rocker arm 8 is resting on the cam follower lever 9 is designed to be adjustable eccentrically.

The described adjusting possibilities can be provided individually or in any combination with each other. In this way, there is the possibility to fine-adjust the rocker arm 8 optimally in its mounted position.

In the internal combustion engine, the valve control devices can be designed such that two neighboring valve control devices for valve lift adjustment in the cylinder head 7 have different control surfaces 34 on the cam follower lever 9 and/or different control surfaces 27*a* on the eccentric member 27 of the control shaft 23.

In the illustrated and preferred embodiment, the curved control surface 19 of the guide element 17 and the control surface 20 of the rocker arm 8 have different radii of curvature. In this way it is achieved that the rocker arm 8 and the guide element 17 substantially are resting on each other with linear contact.

Basically, it is however also possible that the control surfaces 19 and 20 have the same radius of curvature. The described adjustment of the rocker arm 8 is then possible also.

When the camshaft 10 upon operation of the internal combustion engine rotates about its axis 12, the valve stem 2 is opened and closed by the cam follower lever 9 and the rocker arm 8 wherein the lift travel depends on the adjusted position of the rocker arm 8. The pressure spring 6 ensures that the valve cap 5 is always contacting the rocker arm 8 and the valve plate 3 is returned into its closed position. Advantageously, the valve cap 5 is axially slidable relative to the valve stem 2 to a limited extent. In this way, possible clearance between the valve cap 5 and the control surface 30 of the rocker arm 8 can be compensated. In this case, the valve cap 5 is seated on a bolt 41 that projects into the valve stem 2 and which is loaded by the force of a pressure spring 42 surrounding the bolt 41. The spring 42 is supported on the end face of the valve stem 2 as well as on the thicker area 43 of the bolt 41. The pressure spring 42 ensures that, when the valve 1 is closed, the valve cap 5 is resting on the control surface 30 of the rocker arm 8.

The specification incorporates by reference the entire disclosure of German priority document 10 2013 013 913.9 having a filing date of Aug. 16, 2013.

While specific embodiments of the invention have been shown and described in detail to illustrate the inventive principles, it will be understood that the invention may be embodied otherwise without departing from such principles.

What is claimed is:

1. A valve control device for a gas exchange valve of an internal combustion engine, the valve control device comprising:

a cam follower lever that is adapted to interact with a cam of a camshaft of the internal combustion engine;

a rocker arm resting on the cam follower lever and adapted to actuate a gas exchange valve;

an adjusting device acting on the rocker arm so as to adjust the rocker arm for adjusting a valve lift of the gas exchange valve;

wherein the rocker arm has a first curved control surface with a first radius of curvature and a second curved control surface with a second radius of curvature;

wherein the cam follower lever has a third curved control surface with a third radius of curvature;

wherein the first curved control surface of the rocker arm is resting on a fourth curved control surface of a guide element associated with internal combustion engine, wherein the fourth curved control surface has a fourth radius of curvature;

wherein the second curved control surface of the rocker arm is resting on a valve element of the gas exchange valve;

wherein the first, second, third, and fourth radii of curvature are adjusted relative to each other such that, when adjusting a valve lift of the gas exchange valve, the gas exchange valve does not open when the cam follower lever is resting on a base circle section of the cam of the camshaft.

2. The valve control device according to claim 1, wherein the fourth radius of curvature is greater than the first radius of curvature.

3. The valve control device according to claim 1, wherein the fourth radius of curvature and the first radius of curvature are identical.

4. The valve control device according to claim 1, wherein the second radius of curvature is smaller than the first radius of curvature and smaller than fourth radius of curvature.

5. The valve control device according to claim 1, wherein the second radius of curvature is smaller than the first radius of curvature.

6. The valve control device according to claim 1, wherein the second radius of curvature is smaller than the fourth radius of curvature.

7. The valve control device according to claim 1, wherein the third curved control surface has a first control surface section with a section radius of curvature.

8. The valve control device according to claim 7, wherein the third curved control surface has a second control surface section, wherein the first control surface section passes continuously curved into the second control surface section, wherein the second control surface section is curved opposite to the first control surface section.

9. The valve control device according to claim 1, wherein the rocker arm comprises a freely rotatable roller and the freely rotatable roller is resting on the third curved control surface.

10. The valve control device according to claim 1, wherein the rocker arm has a through opening in which the adjusting device is received.

11. The valve control device according to claim 1, wherein the adjusting device comprises a control shaft comprising a fifth control surface, wherein the rocker arm is resting on the fifth control surface.

12. The valve control device according to claim 11, wherein the fifth control surface is a circumferential surface of an eccentric member of the control shaft.

13. The valve control device according to claim 11, wherein the rocker arm comprises a freely rotatable roller resting on the fifth control surface on the control shaft.

14. The valve control device according to claim 1, wherein the rocker arm is supported floatingly in that the first curved control surface of the rocker arm is resting on the guide element and the second curved control surface is resting on the valve element, wherein the rocker arm is secured between the adjusting device and the cam follower lever.

15. The valve control device according to claim 1, wherein the guide element is adjustable transverse to an axis of a control shaft of the adjusting device.

16. The valve control device according to claim 15, wherein the control shaft and the cam follower lever are resting on the rocker arm on opposite sides of the rocker arm.

17. The valve control device according to claim 1, wherein an adjustment of the rocker arm is realized by one or more of the following elements:

the valve element;

an eccentrically adjustable bearing axis of a roller of the cam follower lever resting on the camshaft;

an eccentrically adjustable bearing axis of a roller of the rocker arm that is resting on the cam follower lever;

an eccentrically adjustable bearing axis of a roller of the rocker arm that is resting on a control shaft of the adjusting device;

the guide element that is adjustable.

18. A valve control arrangement comprising two of the valve control device according to claim 1, wherein the two valve control devices are neighboring each other, wherein the cam follower levers are provided with the different third curved control surfaces that are different relative to each other and/or wherein the adjusting devices have control shafts provided with different control surfaces.

* * * * *